US006070644A

United States Patent [19]

Grumm et al.

[11] Patent Number: 6,070,644

[45] Date of Patent: Jun. 6, 2000

[54] INVESTMENT CASTING USING PRESSURE CAP SEALABLE ON GAS PERMEABLE INVESTMENT MOLD

[75] Inventors: Dale A. Grumm, New Era; Bradley S. Donaldson, Zeeland; Mark L. Soderstrom, Fruitport; Dennis Thompson, Whitehall, all of Mich.

[73] Assignee: Howmet Research Corporation, Whitehall, Mich.

[21] Appl. No.: 09/079,129

[22] Filed: May 14, 1998

[51] Int. Cl.[7] ..... B22D 27/13; B22D 27/15

[52] U.S. Cl. ..... 164/66.1; 164/61; 164/65; 164/120; 164/256; 164/258; 164/284

[58] Field of Search ..... 164/61, 62, 65, 164/66.1, 120, 256, 258, 259, 284

[56] References Cited

U.S. PATENT DOCUMENTS

| | | | |
|---|---|---|---|
| 969,539 | 9/1910 | Kitchen . | |
| 1,320,824 | 11/1919 | Bailey et al. . | |
| 1,758,380 | 5/1930 | Spiro . | |
| 1,962,456 | 6/1934 | Myers . | |
| 3,228,073 | 1/1966 | Harrison et al. . | |
| 3,420,291 | 1/1969 | Chandley et al. | 164/66.1 |
| 3,853,635 | 12/1974 | Demendi . | |
| 4,832,105 | 5/1989 | Nagan et al. | 164/61 |
| 5,058,653 | 10/1991 | Garat | 164/34 |
| 5,199,482 | 4/1993 | Rühle | 164/120 |
| 5,301,739 | 4/1994 | Cook | 164/97 |
| 5,335,711 | 8/1994 | Paine | 164/66.1 |
| 5,592,984 | 1/1997 | Schmiedeknecht et al. | 164/62 |

FOREIGN PATENT DOCUMENTS

| | | | |
|---|---|---|---|
| 3920415 | 7/1990 | Germany | 164/120 |
| 58-38656 | 3/1983 | Japan | 164/256 |

*Primary Examiner*—J. Reed Batten, Jr.
*Attorney, Agent, or Firm*—Edward J. Timmer

[57] ABSTRACT

A gas permeable ceramic investment mold is disposed in a casting chamber and filled with melt to be solidified via a mold melt inlet, such as for example a mold pour cup adapted to receive the melt from a melting crucible in the casting chamber. After the melt is cast into the hot investment mold in the vacuum casting chamber, a pressure cap is positioned in sealing engagement with the mold melt inlet, and gas pressure is introduced through the pressure cap to provide selective or local gas pressure on the melt in the mold without pressure cracking or other damage to the relatively fragile investment mold, while the casting chamber is maintained under relative vacuum or a different pressure from that in the mold.

13 Claims, 3 Drawing Sheets

INVESTMENT CASTING USING PRESSURE CAP SEALABLE ON GAS PERMEABLE INVESTMENT MOLD

BACKGROUND OF THE INVENTION

The present invention relates to investment casting of metals and alloys using a gas permeable ceramic investment mold and a pressure cap sealably engageable with the mold in a casting chamber to apply localized pressure on the melt in the mold immediately after it is cast into the mold while maintaining a relative vacuum or different pressure in the casting chamber.

BACKGROUND OF THE INVENTION

In the manufacture of turbine blades and vanes for modern, high thrust gas turbine engines, there has been a continuing demand by gas turbine manufactures for internally cooled blades and vanes having complex, internal cooling passages including such features as pedestals, turbulators, and turning vanes in the passages in a manner to provide desired cooling of the blade or vane. These small cast internal surface features typically are formed by including a complex ceramic core in the mold cavity in which the melt is cast. The presence of the complex core having small dimensioned surface features to form pedestals, turbulators, and turning vanes or other internal surface features renders filling of the mold cavity about the core with melt more difficult and more prone to inconsistency. Wettable ceramics and increased metallostatic head on the mold and higher temperatures have been used in an attempt to improve mold filling and reduce localized voids in such situations, but these are costly and may be restricted by physical size of the casting apparatus.

U.S. Pat. No. 5,592,984 describes a method of investment casting gas turbine engine blades and vanes and other components wherein a ceramic investment mold is disposed in a casting furnace in a casting chamber and filled with the melt with the casting vacuum chamber being gas pressurized rapidly enough after casting to reduce localized void regions present in the melt as a result of surface tension effects between the melt and mold components such as ceramic mold and/or core.

It is an object of the present invention to provide method and apparatus for investment casting using a gas permeable ceramic investment mold and a pressure cap sealably engageable with the mold in a casting chamber to selectively apply pressure internal of the mold on the melt immediately after it is cast into the mold while maintaining a relative vacuum or different pressure in the casting chamber.

SUMMARY OF THE INVENTION

The present invention provides method as well as apparatus for investment casting wherein a gas permeable ceramic investment mold is disposed in a casting chamber and filled with molten metal via a melt inlet of the mold, such as, for example only, a mold pour cup adapted to receive the melt from a melting crucible located in the casting chamber. After the melt is cast into the hot investment mold in the casting chamber, a pressure cap is positioned in engagement with the melt inlet of the hot mold, and gas pressure is introduced through the pressure cap to provide selective or local gas pressure on the melt in the mold inlet without substantial leakage of the gas through the gas permeable mold or damage to the relatively fragile investment mold. The casting chamber can be maintained under relative vacuum or a different pressure from that in the mold while the pressure cap is sealed to the mold. In one embodiment of the present invention, the pressure cap is disposed on a pivoting mechanism in the casting chamber and actuated to pivot the pressure cap toward the hot mold to engage the mold melt inlet and away from the mold melt inlet to disengage therefrom.

In another embodiment of the present invention, the pressure cap carries a sealing gasket for engaging the hot mold in sealing manner to isolate the gas pressure within the mold from the casting chamber such that the casting chamber can be maintained under relative vacuum or a different gas pressure. The pressure cap is pressed against the melt inlet of the hot mold to seal the gasket thereon. For example, an annular sealing gasket on the pressure cap can be pressed on the annular lip of the pour cup of the hot mold to locally gas pressurize the melt residing in the pour cup.

The present invention aids in filling of fine details in the mold cavity that are defined by internal mold surface features and/or core surface features that are otherwise difficult to fill with the melt. The present invention is advantageous in that the gas pressure eliminates the need for a large metallostatic head pressure to achieve fine detail fill and pressurizing gas is not introduced into the casting chamber, which can be maintained under relative vacuum (subatmospheric pressure) or at a different pressure from that present in the mold.

DETAILED DESCRIPTION OF THE INVENTION

The present invention provides method and apparatus for investment casting of metals and alloys and is especially useful in casting nickel, cobalt and iron base superalloys with equiaxed, single crystal, columnar grain microstructures as well as titanium and its alloys and other commonly used metal and alloys. For example only, referring to FIGS. 1 and 2, the present invention can be practiced to make equiaxed grain castings which may be cored or not to produce complex internal passages therein in conventional casting equipment which includes an upper vacuum casting chamber 10 having a vacuum tight sealable access door D1 and a lower mold chamber 13 having a vacuum tight sealable access door D2 communicated to the casting chamber via opening OP.

Figure 1:
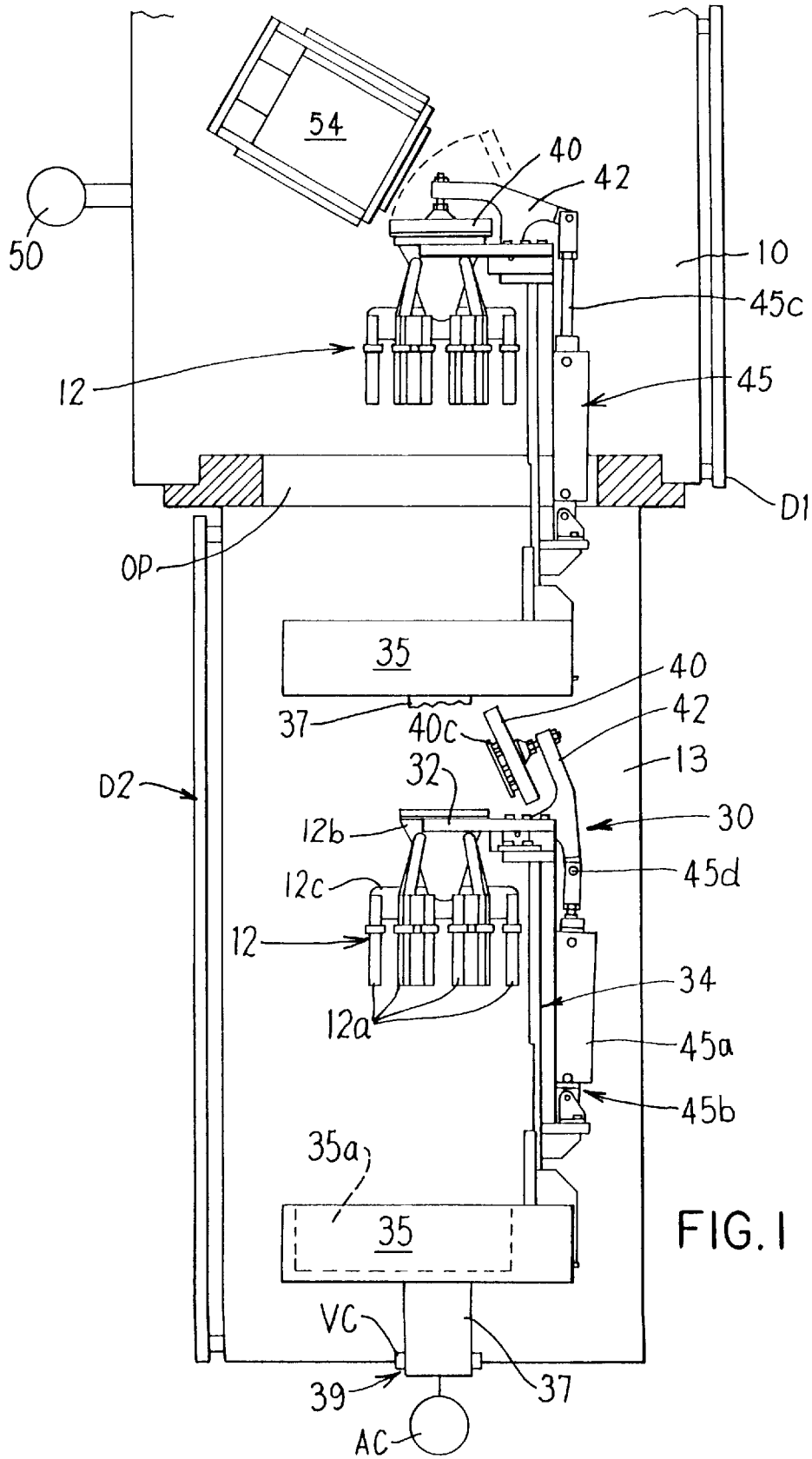
FIG. 1 is a schematic view of casting apparatus in accordance with an embodiment of the invention.
Figure 2:
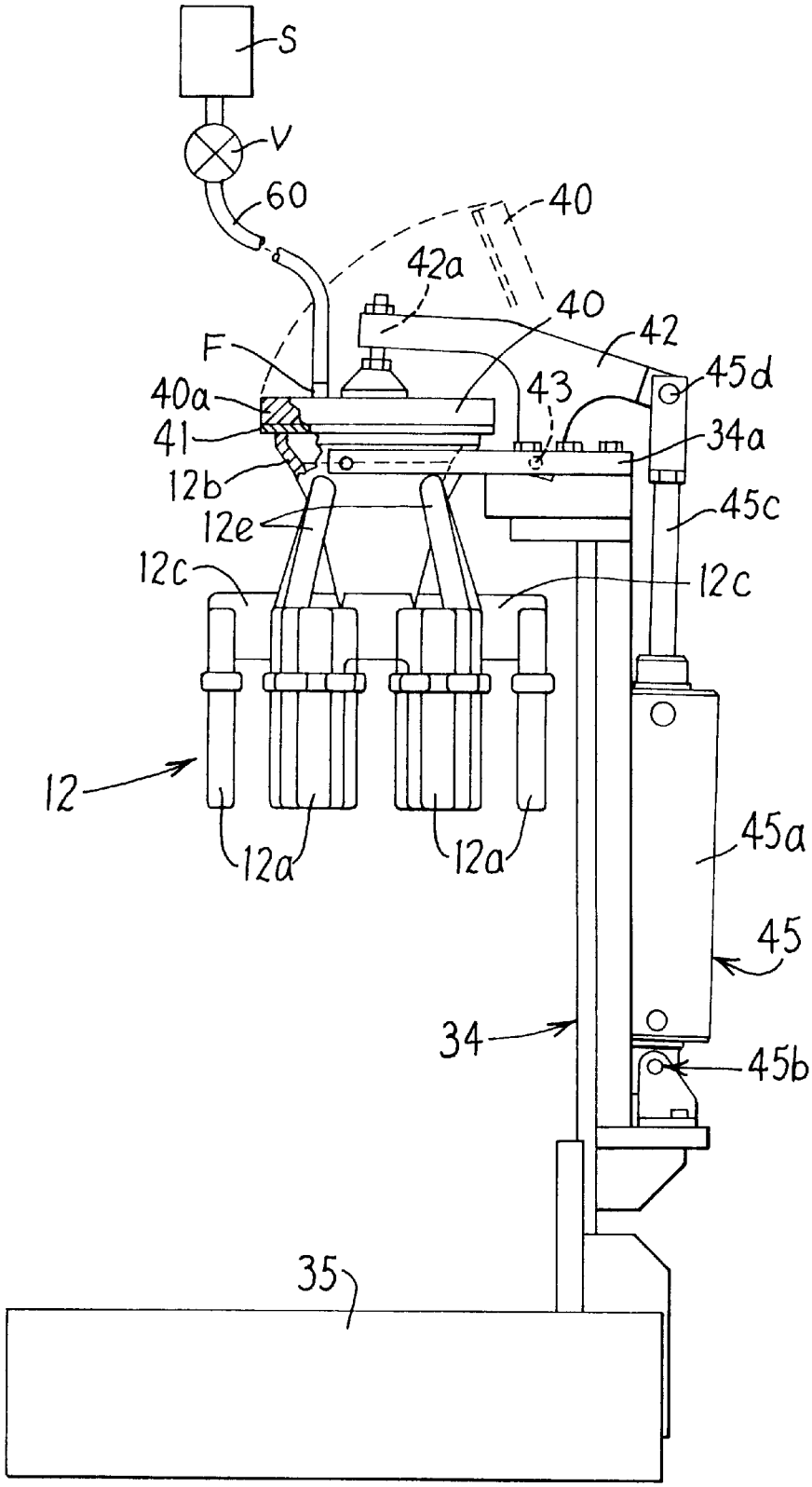
FIG. 2 is an enlarged elevational view of the apparatus features in accordance with an embodiment of the present invention for gas pressurizing melt in a mold pour cup.

Referring to FIGS. 1 and 2, a porous, gas permeable ceramic investment shell mold 12 is first preheated to a suitable casting temperature in a conventional mold heating furnace (not shown) located outside the mold chamber 13 and then is placed via vacuum tight door D2 in the mold chamber 13 supported on a mold holding device 30 in accordance with the present invention. The casting chamber 10 and the mold chamber 13 are evacuable by a vacuum pump 50 to a vacuum level of 15 microns or less for casting such alloys as nickel, cobalt, or iron base superalloys as well as titanium and its alloys. The mold 12 positioned in the chamber 10 or 13 will be evacuated as a result of the mold being gas permeable.

The mold 12 comprises a mold cluster having a plurality of mold cavities 12*a* which are filled with melt that is solidified to form a casting in each mold cavity. The mold cavities 12*a* each can have a ceramic core (not shown) positioned therein to form internal passages and other features in the casting.

The mold cavities 12*a* are disposed about a common pour cup 12*b* and adapted to receive the melt to be cast via respective sprues or runners 12*c* that are communicated in melt flow relation to the pour cup and each mold cavity 12*a*. The mold can include vents 12*e* between the molds cavities 12*a* and the pour cup 12*b* in conventional manner. The pour cup 12*b* receives the melt from a conventional tiltable induction melting crucible 54 disposed in the casting chamber 10 and having induction coil (not shown) about the crucible 54 for heating and melting the charge of metal or alloy to form the melt to be cast. The melt typically is heated to a superheat temperature selected in dependence on the metal or alloy being cast.

The mold 12 typically comprises a ceramic investment shell mold cluster having the features described above and formed by the well known lost wax process wherein a wax or other fugitive pattern of the mold is dipped repeatedly in ceramic slurry, drained, and then stuccoed with coarse ceramic stucco to build up the desired shell mold thickness on the pattern. The pattern then is removed from the invested shell mold, and the shell mold is fired at elevated temperature to develop adequate mold strength for casting. Investment shell molds formed in this manner exhibit porosity and substantial permeability to gas as a result.

In accordance with the present invention, the gas permeable ceramic investment mold 12 is positioned in the mold chamber 13 onto a mold holding collar 32 of the mold holding device 30 wherein the collar 32 is disposed at least partially about the pour cup 12*b* as shown in FIGS. 1 and 2. The mold holding collar 32 is supported on an upstanding support member 34 itself mounted on a base 35 that rests on a ram 37 of a hydraulic or other elevator 39. The elevator ram 37 extends through a suitable vacuum seal VS in the bottom wall of chamber 13 to a conventional hydraulic or other actuator AC so as to raise and lower the elevator ram 37 to move the mold 12 between the mold chamber 13 and the casting chamber 10. The base 35 defines a receptacle 35*a* to catch debris that may fall from the mold 12 as well as melt splatter during pouring of the melt from the crucible 54 into the mold pour cup 12*b*.

A pressure cap 40 is shown mounted on an end 42*a* of pivotal cap support member 42, which is pivotally mounted on an upper plate 34*a* of the upstanding support member 34 by pivot pin 43. A pneumatic or other fluid actuator 45 is mounted on the upstanding support member 34 to pivot the cap support member 42 about pivot pin 43. To this end, the actuator includes a fluid (e.g. inert gas) cylinder 45*a* having a lower end mounted on the support member 34 by a pivot connection 45*b* and a piston rod 45*c* that is connected to the cap support member 42 by a pivot connection 45*d*.

The fluid actuator 45 is actuated to move the pressure cap 40 to a generally horizontal sealing position shown in sealing engagement with the mold pour cup 12*b* and a non-sealing position shown in dashed lines away from the pour cup 12*b* with the pressure cap 40 oriented in an inclined orientation.

Figure 2A:
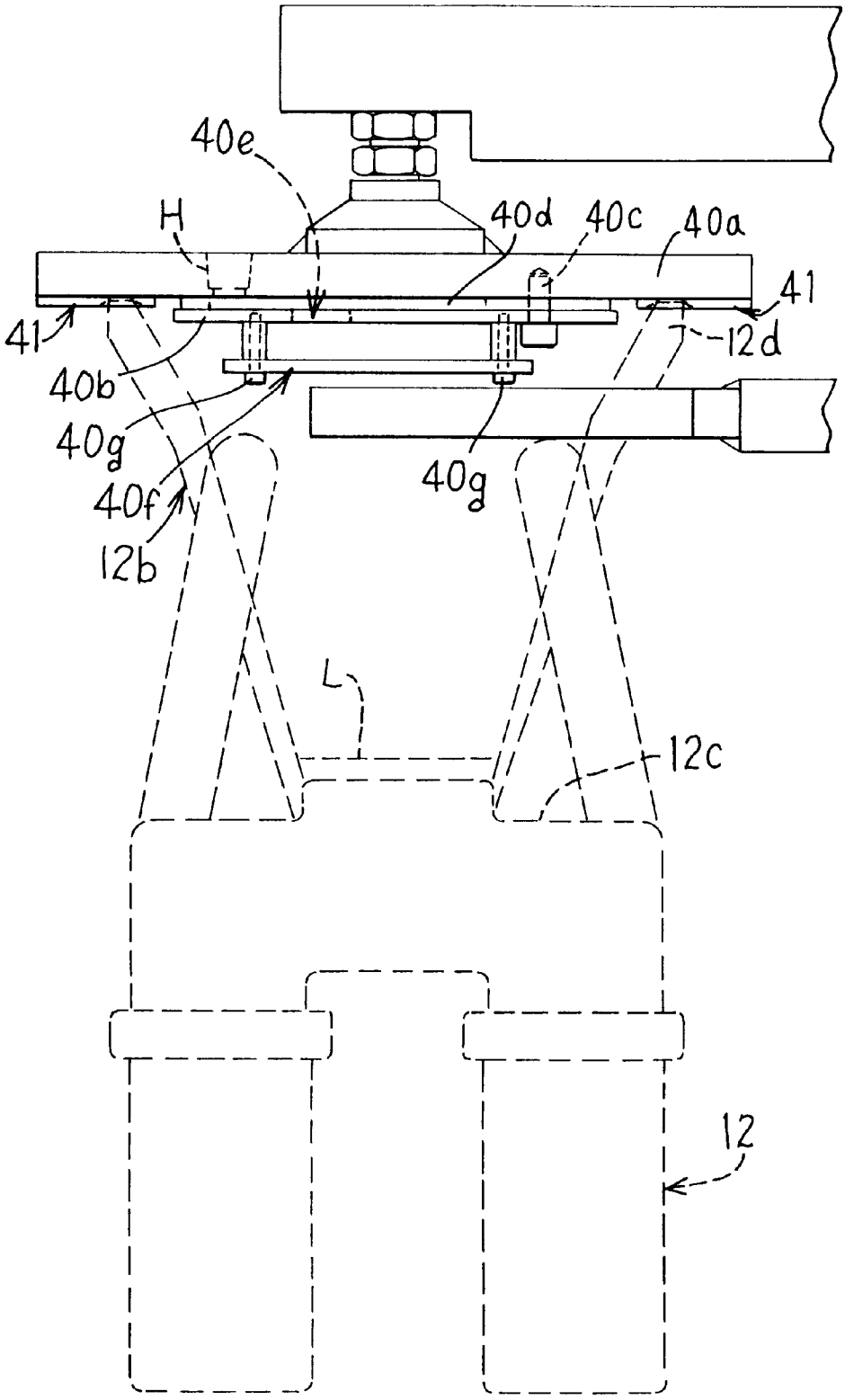
FIG. 2A is an enlarged view of the mold and pressure cap.

The pressure cap 40 includes a first plate 40*a* and a second annular plate 40*b* bolted thereto by bolts 40*c* with the first plate 40*a* carrying a flat and annular fiber gasket 41 (e.g. aluminum silicate fiber gasket) as shown in FIG. 2A that is pressed on and in engagement with the annular pour cup lip 12*d* of the hot mold 12 when the pressure cap is in the solid line position shown in FIG. 2. A gas manifold 40*d* is defined by plates 40*a*, 40*b*. In operation, the pressure cap 40 is moved by the aforementioned pivoting mechanism to sealingly press on the annular pour cup lip 12*d* of the hot mold 12 after the melt is introduced from the crucible 54 into the preheated mold 12 to fill the mold cavities 12*a* and provide some melt in the mold pour cup 12*b* and before solidification of the fine casting details (e.g. within approximately 2 seconds for equiaxed castings).

The pressure cap plate 40*a* includes a threaded hole H for receiving fitting F to which a flexible conduit 60 is connected. The flexible conduit 60 is connected to a source S of pressurized inert gas (e.g. a conventional argon cylinder) disposed outside the casting chamber 10 by opening a valve V also disposed outside the chamber 10 between the conduit 60 and source S. The source S and valve V are stationary while the flexible conduit 60 travels up/down between chambers 10, 13 with the pressure cap 40.

After the pressure cap 40 is engaged on the pour cup lip 12*d*, the valve V is opened to communicate the flexible gas conduit 60 to the source S of pressurized inert gas and to manifold 40*d* to thereby introduce localized inert gas pressure on the melt residing in the mold pour cup 12*b* at a relatively low level L just above the runners 12*c*. To this end, the pressure cap manifold 40*d* includes an outlet orifice or opening 40*e* for directing the inert gas against a lower gas deflector plate 40*f* spaced therefrom by a plurality standoffs 40*g* bolted to plate 40*b*, FIG. 2A, so that the inert gas is forced to the sides of the mold pour cup 12*b* and can expand uniformly downward onto the molten metal therein. The level L of the melt in the mold pour cup 12*b* is maintained as low as possible to reduce the need for and usage of molten metal or alloy in the mold and achieves cost savings especially when expensive metals or alloys are being cast. A sufficient inert gas pressure can be provided on the melt residing in the pour cup 12*b* effective to enhance filling of fine details in the mold cavity 12*a* defined by the internal mold surface features and/or core surface features that are otherwise difficult to fill with the melt. For purposes of illustration and not limitation, inert gas pressure to this end can be about 0.1 atmosphere to greater than 1 atmosphere, such as 0.3 to 2 atmospheres, depending on the mold strength. The fiber sealing gasket 41 engaged on the mold pour cup lip 12*d* minimizes leakage of inert gas into the casting chamber 10 at the same time so that the casting chamber 10 and mold chamber 13 can be maintained under relative vacuum by operation of vacuum pump 50 while the pressure cap 40 is pressed on the pour cup lip 12*d* or at a different pressure from that locally present in the mold in the event vacuum pump 50 is not operational during this time.

The pressure cap 40 can be maintained in engagement with the mold lip as the melt-filled mold 12 is moved from the casting chamber 10 downward to the mold chamber 13 by the elevator 39 with gas pressure continued to be applied to the melt in the pour cup 12*b* for approximately 2 to 3 or more seconds after filling of the mold with molten metal. Alternately, the pressure cap 40 can be engaged and inert gas pressure applied until the metal-filled mold 12 is ready to be released from the collar 32. The pressure cap 40 is moved away from the mold pour cup lip 12*d* in chamber 13 (to the disengaged position shown in FIG. 1 by the aforementioned pivoting mechanism) and the gas pressure is terminated by closing valve V when the door D2 of the mold chamber 13 is opened to permit movement of the melt-filled mold 12 outside the chamber 13. At this point in time, the molten metal or alloy in the mold 12 to produce equiaxed castings is not solidified or is only partially solidified. The melt-filled mold 12 can be moved from the chamber 13 to ambient atmosphere for solidification of the equiaxed casting in ambient air, or alternately into a vacuum or inert gas chamber (not shown) for solidification under a relative vacuum or inert gas. The mold 12 can be moved into and out of the mold chamber 13 by an individual using a pitchfork-like tool, by a mold unloading robot, or other unloading device that picks the mold up off the collar 32 and moves it out of the chamber 13 via open door D2.

The present invention is advantageous to aid in filling of fine details in the mold cavity defined by the internal mold surface features and/or core surface features that are otherwise difficult to fill with the melt. The present invention artificially creates metallostatic head pressure without the use of excessive additional metal or alloy in the mold pour cup. Since the metal or alloy for some castings configurations is the most expensive material used in the manufacture of the component, significant cost savings associated with the metal or alloy are achieved. The present invention is advantageous in that the pressurizing gas is not introduced into the casting chamber, which can be maintained under relative vacuum (subatmospheric pressure) or at a different pressure from that present in the mold. Localized pressurizing of the mold pour cup is advantageous to provide higher gas pressure in more rapid time than available when the entire casting chamber is gas pressurized. Moreover, damage to casting furnace components from gas pressurization is reduced with a faster recovery of vacuum in the casting chamber for the next mold to be cast than available when the entire casting chamber is evacuated.

It is to be understood that the invention has been described with respect to certain specific embodiments thereof for purposes of illustration and not limitation. The present invention envisions that modifications, changes, and the like can be made therein without departing from the spirit and scope of the invention as set forth in the following claims.

We claim:

1. Investment casting method comprising positioning a gas permeable ceramic investment mold having a mold cavity to be filled with melt in a casting chamber, introducing a melt into the mold through a melt inlet of said mold, engaging a pressure cap to the melt inlet after the melt is introduced in the mold, and introducing gas pressure via the pressure cap on the melt residing in the hot mold to provide localized gas pressure on said melt effective to improve filling of the mold cavity with the melt, while the casting chamber is maintained under relative vacuum or at a different pressure from that locally present in the mold.

2. The method of claim 1 wherein the pressure cap is pivoted in the casting chamber to sealingly engage a sealing gasket on the pressure cap with the mold melt inlet.

3. The method of claim 2 wherein the sealing gasket is sealingly pressed onto an annular mold pour cup lip.

4. The method of claim 1 wherein an inert gas is introduced through a passage in the pressure cap into the mold to provide said gas pressure locally therein.

5. The method of claim 1 wherein the mold is positioned in the casting chamber by engaging a pour cup of said mold with a mold holding means.

6. The method of claim 1 including the additional step of disengaging the pressure cap from the melt inlet to allow removal of the mold from the casting chamber.

7. Apparatus for investment casting a melt, comprising a gas permeable ceramic investment mold having a mold cavity positioned in a casting chamber, means for introducing a melt into the mold through a melt inlet of said mold, a pressure cap sealingly engagable to the melt inlet after the melt is introduced in the mold, and means for introducing gas pressure via the pressure cap on the melt residing in the mold to provide localized gas pressure on said melt effective to improve filling of the mold cavity with the melt, while the casting chamber is maintained under relative vacuum or at a different pressure from that locally present in the mold.

8. Apparatus of claim 7 including a pivoting mechanism positioned in the casting chamber and on which the pressure cap is disposed for pivoting in the casting chamber to sealingly engage a sealing gasket on the pressure cap to the mold melt inlet.

9. Apparatus of claim 8 wherein the pivoting mechanism is actuated to sealingly press the sealing gasket onto an annular mold pour cup lip.

10. Apparatus of claim 7 wherein said means for introducing gas pressure comprises a source of inert gas communicated to a conduit in the pressure cap for introducing the inert gas into the mold to provide said gas pressure locally therein.

11. Apparatus of claim 7 including a mold holding means for suspending the mold in the casting chamber from a mold pour cup.

12. Apparatus of claim 11 wherein the mold holding means comprises a support collar disposed at least partially about the exterior of the pour cup.

13. Apparatus of claim 7 wherein the mold comprises a mold cluster having multiple mold cavities.

* * * * *